US007255174B2

(12) United States Patent
Thompson

(10) Patent No.: US 7,255,174 B2
(45) Date of Patent: Aug. 14, 2007

(54) CEMENT CONTROL RING

(75) Inventor: Grant R. Thompson, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 343 days.

(21) Appl. No.: 10/888,317

(22) Filed: Jul. 9, 2004

(65) Prior Publication Data

US 2005/0016734 A1 Jan. 27, 2005

Related U.S. Application Data

(60) Provisional application No. 60/487,736, filed on Jul. 16, 2003.

(51) Int. Cl.
*E21B 34/14* (2006.01)

(52) U.S. Cl. ..... 166/332.8; 166/334.1

(58) Field of Classification Search ..... None
See application file for complete search history.

(56) References Cited

U.S. PATENT DOCUMENTS

| | | | | |
|---|---|---|---|---|
| 4,629,002 | A | 12/1986 | Pringle | |
| 4,722,399 | A | 2/1988 | Pringle | |
| 4,926,945 | A | 5/1990 | Pringle et al. | |
| 5,058,682 | A | 10/1991 | Pringle | |
| 5,145,005 | A | 9/1992 | Dollison | |
| 5,293,943 | A | 3/1994 | Williamson, Jr. | |
| 5,310,004 | A * | 5/1994 | Leismer | 166/321 |
| 5,862,864 | A | 1/1999 | Witeford | |
| 5,884,705 | A | 3/1999 | Hill, Jr. | |
| 6,109,351 | A | 8/2000 | Beall | |
| 6,152,232 | A | 11/2000 | Webb et al. | |
| 6,209,663 | B1 | 4/2001 | Hosie | |
| 6,328,062 | B1 | 12/2001 | Williams et al. | |
| 6,425,413 | B2 | 7/2002 | Davis et al. | |
| 2002/0170719 | A1 | 11/2002 | Deaton | |
| 2004/0045722 | A1 | 3/2004 | Sangla | |

FOREIGN PATENT DOCUMENTS

| | | |
|---|---|---|
| GB | 2270530 A | 3/1994 |
| GB | 2370298 A | 6/2002 |

* cited by examiner

*Primary Examiner*—Zakiya W. Bates
(74) *Attorney, Agent, or Firm*—Steve Rosenblatt

(57) ABSTRACT

A sealing system for a flow tube keeps cement from getting around it to the flapper when the safety valve is in the open position. Seals are provided at opposed ends of the flow tube so that the power spring and the flapper will not get fouled with cement pumped through the flow tube in wells that are completed through a production string with the safety valve in place. The seals may be mounted to the flow tube or the surrounding body. A unique seal construction separates cement from the flapper behind the flow tube. The force acting on the flow tube to hold the valve open also helps to apply a force against the lower seal adjacent the flapper.

22 Claims, 5 Drawing Sheets

CEMENT CONTROL RING

PRIORITY INFORMATION

This application claims the benefit of U.S. Provisional Application No. 60/487,736 filed on Jul. 16, 2003.

FIELD OF THE INVENTION

The field of the invention is subsurface safety valves and more particularly those used in well completion procedures where cement or similar material is pumped through the flow tube that operates the flapper.

BACKGROUND OF THE INVENTION

A subsurface safety valve ("safety valve") is typically installed in well tubing. Normally, the well is drilled and cased. The casing is cemented and the formation is perforated through the casing. A production string, having a packer is run in and the well is put into production through the tubing. The safety valve is in the production string and is normally operated from the surface through one or more control lines that are run in the annular space between the tubing and the casing and above the packer. The pressure applied to the control line drives a piston against an operating spring. The piston is linked to a flow tube such that applied pressure drives the piston and the flow tube against a flapper to rotate it 90° to open the safety valves. When control line pressure is removed the power or closure spring drives the flow tube in the reverse direction and a spring on the flapper rotates it in the reverse direction against a seat such that flow from below the valve in an uphole direction stops. It should be noted that in these types of completions, the cement does not pass through the valve when the casing is cemented because the production string is run in after the casing is cemented.

Of late, a new type of well system has been used where the casing is not used. Instead, a smaller hole is drilled and production tubing is inserted with a safety valve and the production tubing is cemented into the borehole. In such application the safety valve has to pass cement through the flow tube. The new issue confronting safety valve manufacturers in dealing with this type of application is how to maintain the integrity of the flapper mechanism during the cementing process.

FIG. 1 illustrates a previous unsuccessful attempt to insure the integrity of the safety valve flapper mechanism for operation after cementing through the safety valve. Safety valve 10 has a flapper 12 pinned at 14 for rotation between the open and closed positions, as shown by arrow 16. FIG. 1 is a split view illustrating the open position on top and the closed position at the bottom. The flow tube 18 is actuated by piston 20 that happens to be a rod piston. A control line (not shown) is connected at connection 22 to urge piston 20 down against the opposing force from power spring 24. Thus, a pressure buildup in cavity 26 opens the safety valve 10 by pushing the flapper 12 back behind the translated flow tube. Located in a groove 28 is a resilient o-ring 30 for sealing between the flow tube 18 and the body 32. The thinking behind the addition of the o-ring 30 was to prevent cement pumped through the flow tube 18 from getting in behind it and into the spring cavity 34 and fouling future operation of the safety valve 10. FIG. 1 shows that at the lower end 36 of the flow tube 18 there was a gap 38 to the body 32. This gap was put there for a specific reason. Since the diameter of the flow tube was greater near its upper end 40 than the lower end 36, allowing the gap 36 to be sealed closed could have put a net unbalanced force on the flow tube 18 from internal pressure in passage 42. The problem was, that gap 38 also allowed cement into cavity 44 and that fouled the working of the flapper 12.

Accordingly what was needed was a design that could effectively isolate the flapper during cementing so that the safety valve could function reliably thereafter. At the same time the design needed to be configured so that the flow tube would not become trapped in the valve open position due to sealing off the flow tube in the valve body at its upper and lower ends during the cementing operation. Additionally, the present invention improves on the use of a resilient o-ring seal and substitutes improved sealing around the flow tube for greater reliability. These and other aspects of the present invention can be readily appreciated by those skilled in the art from a review of the description of the preferred embodiment and the claims, which appear below.

SUMMARY OF THE INVENTION

A sealing system for a flow tube to keep cement from getting around it to the flapper when the safety valve is in the open position is disclosed. Seals are provided at opposed ends of the flow tube so that the power spring and the flapper will not get fouled with cement pumped through the flow tube in wells that are completed through a production string with the safety valve in place. The seals may be mounted to the flow tube or the surrounding body. A unique seal construction is also disclosed. The force acting on the flow tube to hold the valve open also helps to apply a force against the lower seal adjacent the flapper.

DETAILED DESCRIPTION OF THE PREFERRED EMBODIMENT

Figure 1:
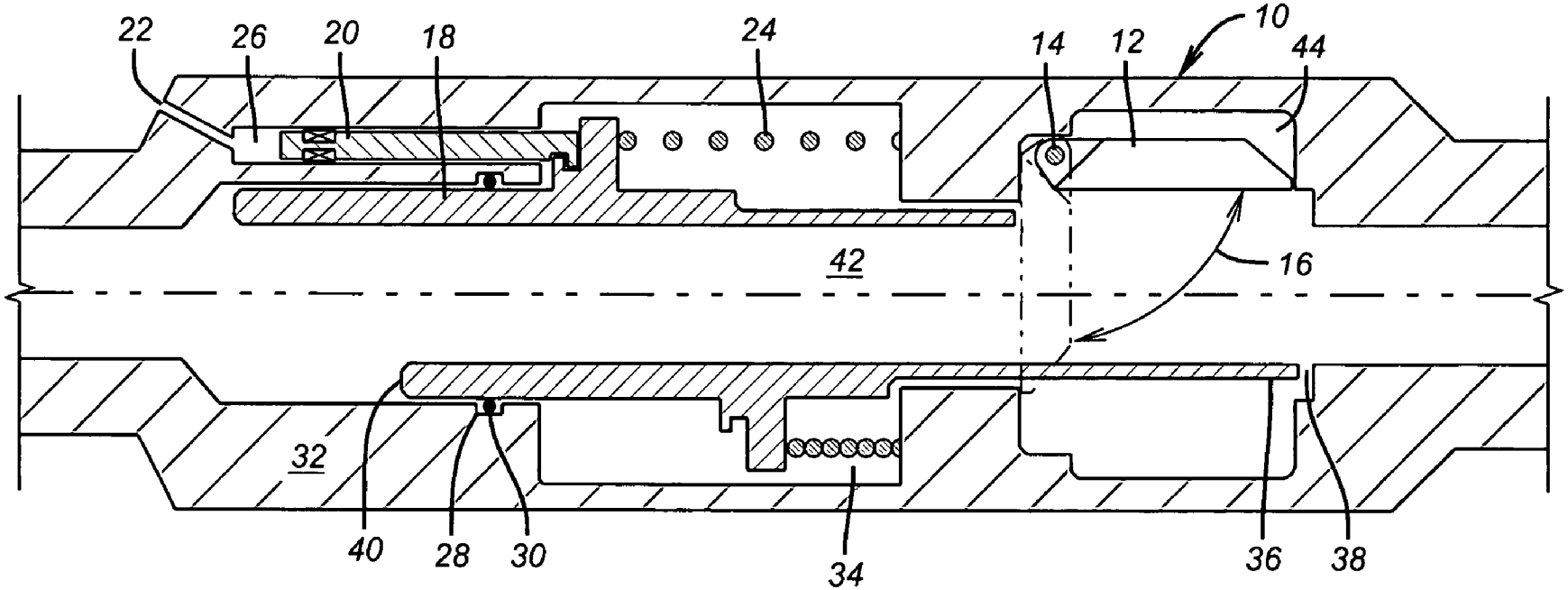
(PRIOR ART) FIG. 1
FIG. 1 is a sectional view of a prior art design that used an o-ring near the top of the flow tube and left a gap to the body at the lower end of the flow tube.

Referring to FIG. 1*a* the body 46 has a female component 48 secured to male component 50 at thread 52. Passage 54 has a control line from the surface (not shown) connected to it for selectively pressurizing the chamber 56. Male component 50 has a thin wall 58 to define, in part the cavity 56 and to selectively penetrate into it, when necessary, for a backup mode of operation without using passage 54.However, the preferred access point into cavity 56 is through the flow tube 60 and into annular recess 61, see FIG. 2*c*. After that a wireline insert valve can be inserted and operated from passage 54. Flow tube 60 has an upper end 62. It retains a seal assembly 64 with a snap ring 66. The flow tube 60 has a shoulder 68 against which the power spring 70 engages. Body 46 has a sub 72, see FIG. 2*c*, connected at threads 74 to support the ring 76 against which bears the lower end 78 of power spring 70. Lower seal assembly 80 seals between sub 72 and the flow tube 60. Accordingly between the threads 52 and 74 and seals 64 and 80, the chamber 56 is sealed off so that pressure applied to the passage 54 will push the flow tube 60 down against power spring 70 to move the flapper 82 to its open position 82'. Flapper 82 is pinned at 84 and has a spring assembly 86 to urge it to the closed position against a conforming seat 88. Moving the flow tube 60 downwardly to bring its lower end 90 down, displaces the flapper 82 against spring 86 to put the flapper 82' into the open position.

In the course of downward movement of the lower end of the flow tube 60, it encounters a seal 92 supported off the body 46. The lower end 90 is shown having a bevel 94 and the seal 92 has a bevel 96. In the preferred embodiment, bevels 94 and 96 do not match so that there is a line contact between the lower end 90 and the seal 92.Alternativeley, there could be surface contact if the touching surfaces are more aligned. The sloping surfaces and line contact put an outward force on the seal 92 when engaged by the lower end 90 to force the seal 92 against the housing 46 for better sealing all around. When the flow tube 60 is moved all the way down, the flapper 82 and its closure spring 86 and the pinned connection 84 are protected from cement or other material that is passed through the flow tube 60 during a completion process. The seals 64 and 80 protect the cavity 56 in which the power spring 70 resides from the potentially contaminating materials during the completion process.

The dynamic seals 64 and 80 are preferably spring-energized, non-elastomeric lip seals. The seal jackets of the dynamic seal assembly are made of a plastic compound immune to explosive decompression, chemically inert, and with enhanced wear and friction properties compared to elastomeric compounds. The dynamic seals 64 and 80 isolate the spring cavity 56 from wellbore fluids. TEI Sealing Systems LLC makes the dynamic seals 64 and 80. They are similar to the dynamic seals from Greene-Tweed that were used previously for sealing around a rod-piston in a safety valve.

Figure 2A:
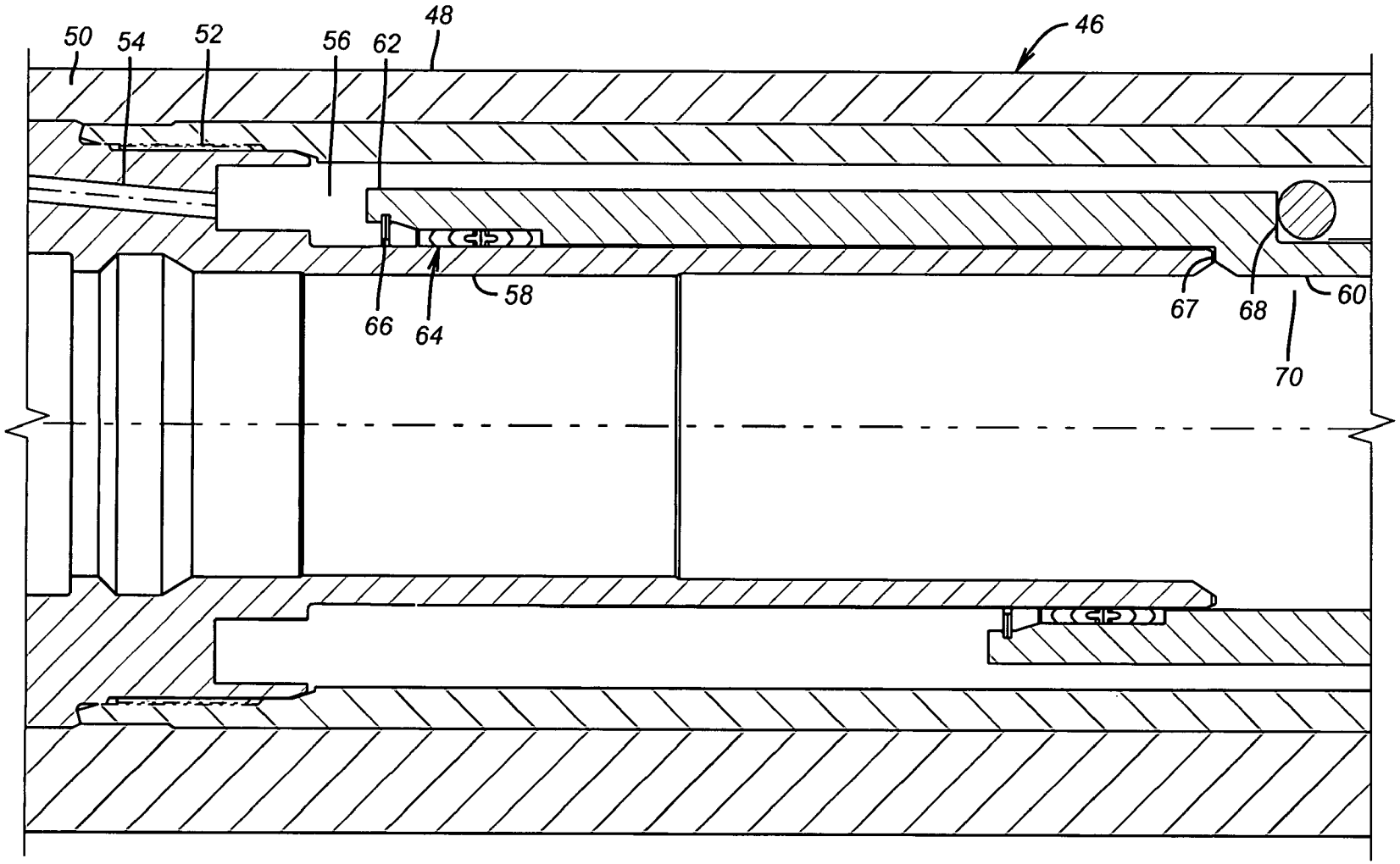
FIGS. 2*a*–2*d* are a split view in section showing the present invention with the safety valve open and closed.
Figure 2B:
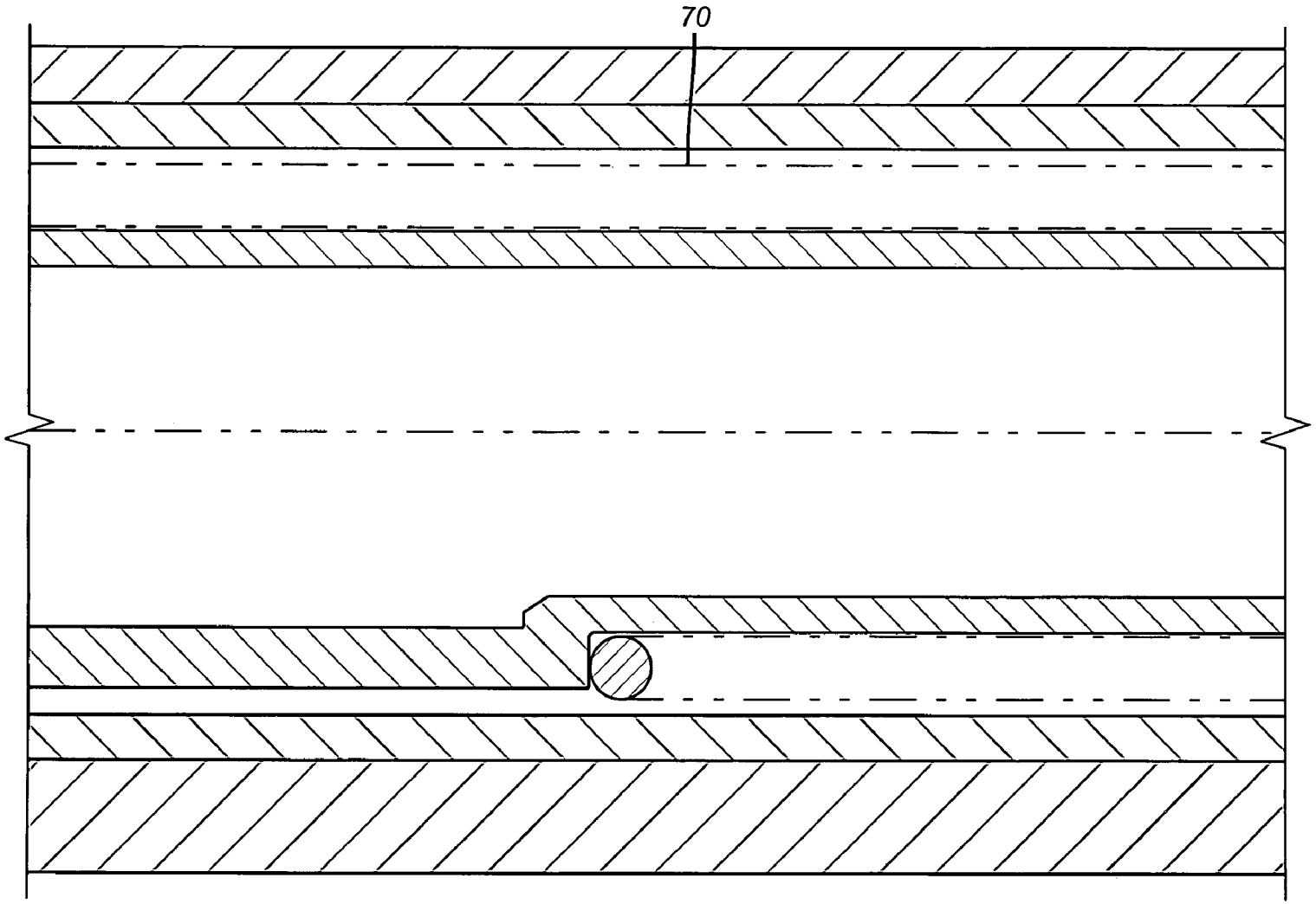
Figure 2C:
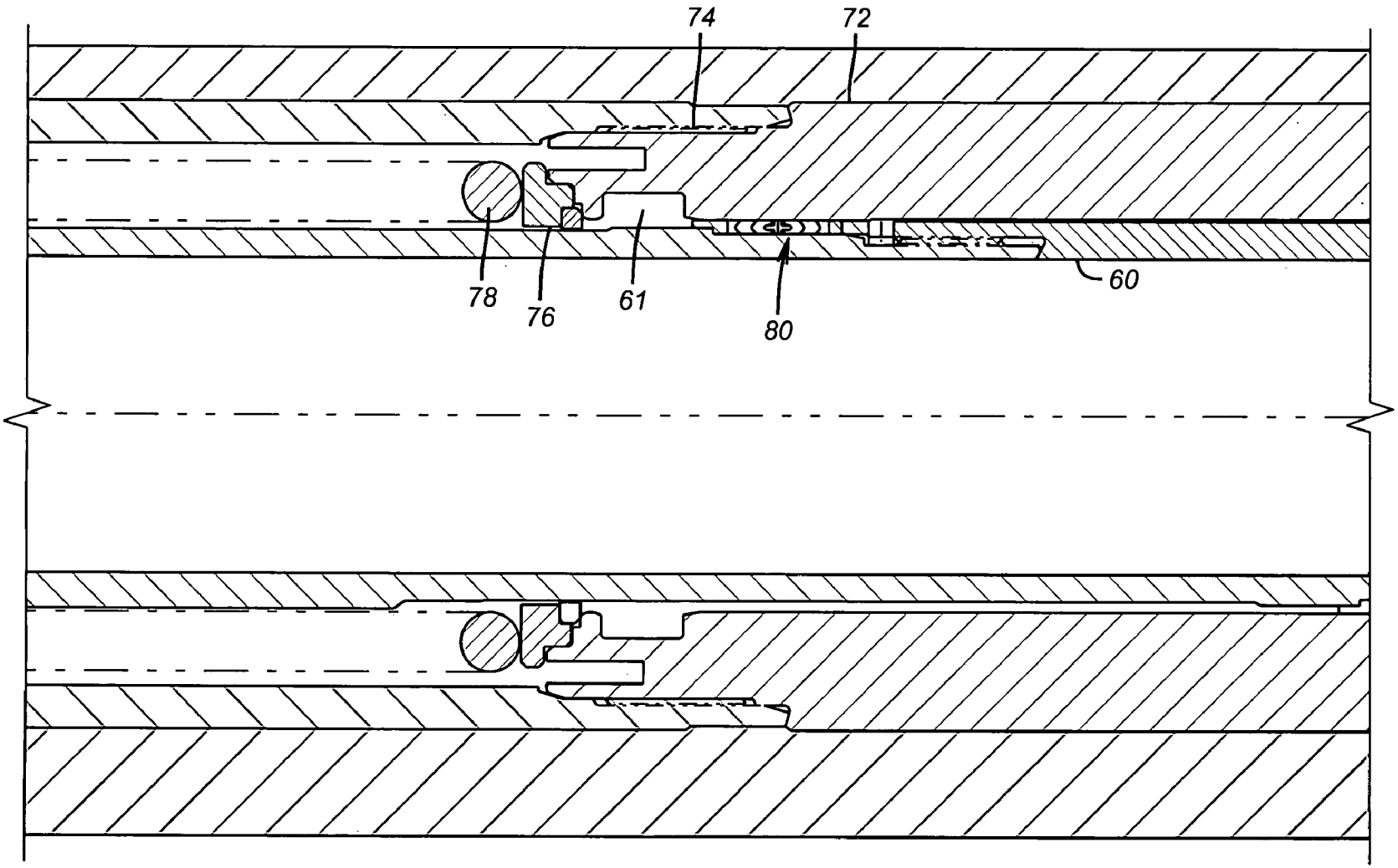
Figure 2D:
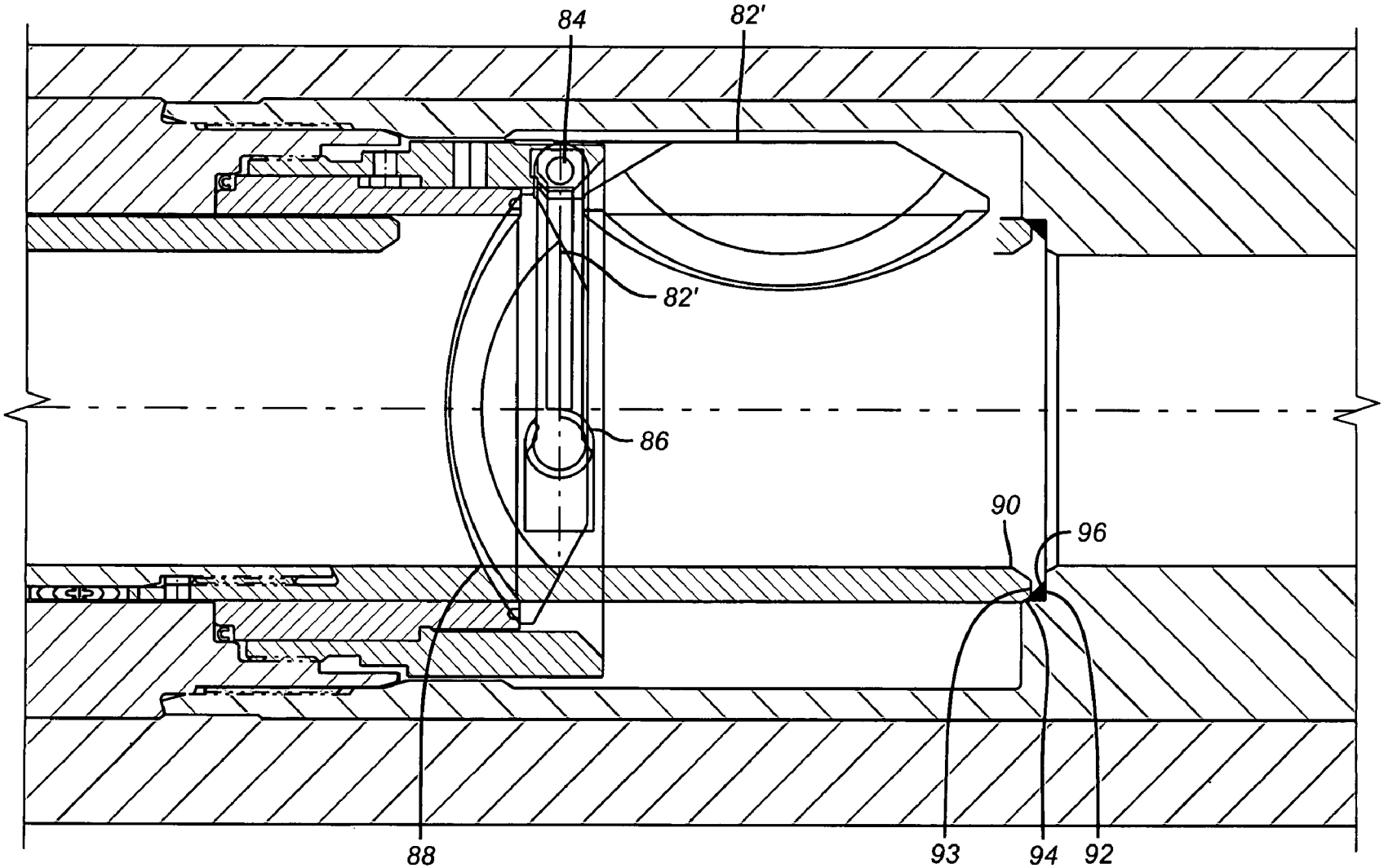

In FIG. 1 an O-ring was used as a barrier to prevent cement from moving into the spring cavity 34 from the top end the spring cavity 34 was packed with grease. The O-ring 30 was subject to explosive decompression, caused unacceptable variance in opening and closing pressures due to friction, and did not prevent cement from migrating into the spring cavity through the bottom end of the flow tube 18 through gap 38. Packing the spring cavity with grease was also ineffectual, as opening the valve caused a portion of the grease to be forced out of the spring cavity.

Those skilled in the art will appreciate that the sealing system to protect the flapper in the present invention can be adapted to operate in safety valves that have a wide variation in actuation systems for the flow tube. The emphasis is to keep the closure mechanism free from cement or other materials that could later cause malfunction. Thus, when the safety valve is placed in the open position, the flapper assembly and the power spring are effectively protected. The system works regardless of whether the safety valve is actuated by a rod or an annular piston or pistons. Other downhole equipment can be protected from cement or other contaminants during completion in a similar manner.

The reason a gap 38 was left in the prior design of FIG. 1 was to prevent a situation where pressure inside the flow tube 18 in passage 42 with the flow tube all the way down and sealed at its lower end 36 would experience such a large unbalanced force so that the power spring 24 would not be able to overcome it to allow the valve to close. This could occur because the piston area near the top end 40 was much larger than the piston area near the lower end 36. In the present invention, FIGS. 2*a*–2*d*, those piston areas have been reconfigured to be closer in area to each other to diminish, if not eliminate, the unbalanced force acting on the flow tube 60 when it is sealed at the lower end 90 against seal 92 and at the upper end by seal 64. In effect shoulder 67 shown in FIG. 1*a* is the upper piston area versus an equal of nearly equal lower piston area 93 near the lower end 90. In any event the power spring 70 is sized to overcome any residual force on the flow tube 60 when in the closed position and sealed to the body 46 at opposed ends.

It should be noted that seal 92 can be carried on the flow tube 60 or on the body 46 or it can be in both places. The material used should be compatible with the anticipated fluids, temperatures and pressures during the completion operation.

The foregoing disclosure and description of the invention are illustrative and explanatory thereof, and various changes in the size, shape and materials, as well as in the details of the illustrated construction, may be made without departing from the spirit of the invention.

I claim:

1. A safety valve for downhole use, comprising:

a body having a passage extending through it, a flapper pivotally mounted to selectively close said passage, a flow tube to selectively operate said flapper and pass in front of it to open said passage, said flow tube biased away from said flapper by a closure spring mounted in a cavity defined by said body and the outside of said flow tube;

at least one seal between said outside of said flow tube and said body;

said at least one seal is mounted to at least one of said body and said flow tube at or between opposed ends of said flow tube;

said at least one seal isolates said cavity from said passage when said flapper is open;

said at least one seal comprises an upper and a lower seal spaced apart along said flow tube.

2. The valve of claim 1, wherein:

said upper and said lower seals are non-elastomeric.

3. The valve of claim 2, wherein:

said upper and said lower seals are formed of a plastic resistant to explosive decompression.

4. The valve of claim 3, wherein:

said upper and said lower seals are spring energized lip seals.

5. The valve of claim 1, wherein:

said at least one seal comprises an end seal energized when said flow tube is moved to a position where its lower end approaches said housing to displace said flapper, whereupon fluids passing through said flow tube are sealed off from said flapper by said end seal.

6. The valve of claim 5, wherein:

said end seal is mounted to at least one of said body and a lower end of said flow tube.

7. The valve of claim 6, wherein:

said end seal comprises a bevel.

8. The valve of claim 7, wherein:

said bevel seals by line contact therewith.

9. The valve of claim 7, wherein:

said bevel seals with surface contact therewith.

10. The valve of claim 7, wherein:

said end seal is forced radially outwardly toward said body by movement of said flow tube that rotates said flapper.

11. The valve of claim 1, wherein:

said at least one seal further comprises an end seal energized when said flow tube is moved to a position where its lower end approaches said housing to displace said flapper, whereupon fluids passing through said flow tube are sealed off from said flapper by said end seal.

12. A safety valve for downhole use, comprising:

a body having a passage extending through it, a flapper pivotally mounted to selectively close said passage, a flow tube to selectively operate said flapper and pass in front of it to open said passage, said flow tube biased away from said flapper by a closure spring mounted in a cavity defined by said body and the outside of said flow tube;

at least two seals between said flow tube and said body; and said seals isolate said cavity from said passage when said flapper is open.

13. The valve of claim 12, wherein:

said at least one seal further comprises an end seal energized when said flow tube is moved to a position where its lower end approaches said housing to displace said flapper, whereupon fluids passing through said flow tube are sealed off from said flapper by said end seal.

14. The valve of claim 13, wherein:

said seals comprise an upper and a lower seal disposed respectively near an upper and lower end of said flow tube.

15. The valve of claim 13, wherein:

said flow tube configured to be in pressure balance from applied pressure from within said passage.

16. The valve of claim 13, wherein:

said end seal is forced radially outwardly toward said body by movement of said flow tube that rotates said flapper.

17. The valve of claim 13, wherein:

said end seal is mounted to at least one of said body and a lower end of said flow tube;

said end seal comprises a bevel;

said bevel seals by one of line contact and surface contact therewith.

18. A safety valve for downhole use, comprising:

a body having a passage extending through it, a flapper pivotally mounted to selectively close said passage, a flow tube to selectively operate said flapper and pass in front of it to open said passage, said flow tube biased away from said flapper by a closure spring mounted in a cavity defined by said body and the outside of said flow tube;

at least two seals between said flow tube and said body to isolate said cavity when said passage is open;

said at least one seal further comprises an end seal energized when said flow tube is moved to a position where its lower end approaches said housing to displace said flapper, whereupon fluids passing through said flow tube are sealed off from said flapper by said end seal.

19. The valve of claim 18, wherein:

said flow tube configured to be in pressure balance from applied pressure from within said passage.

20. The valve of claim 19, wherein:

said seals comprise an upper and a lower seal disposed respectively near an upper and lower end of said flow tube.

21. The valve of claim 18, wherein:

said end seal is forced radially outwardly toward said body by movement of said flow tube that rotates said flapper.

22. The valve of claim 18, wherein:

said end seal is mounted to at least one of said body and a lower end of said flow tube;

said end seal comprises a bevel;

said bevel seals by one of line contact and surface contact therewith.

* * * * *